US010815655B2

(12) United States Patent
Febbo

(10) Patent No.: US 10,815,655 B2
(45) Date of Patent: Oct. 27, 2020

(54) CONNECTION DEVICE FOR FASTENING TWO ELEMENTS, IN PARTICULAR FOR BUILDING CONSTRUCTION

(71) Applicant: Franco Febbo, Bruino (IT)

(72) Inventor: Franco Febbo, Bruino (IT)

( * ) Notice: Subject to any disclaimer, the term of this patent is extended or adjusted under 35 U.S.C. 154(b) by 445 days.

(21) Appl. No.: 15/750,592

(22) PCT Filed: Aug. 6, 2016

(86) PCT No.: PCT/IB2016/054762

§ 371 (c)(1),
(2) Date: Feb. 6, 2018

(87) PCT Pub. No.: WO2017/025886

PCT Pub. Date: Feb. 16, 2017

(65) Prior Publication Data

US 2019/0010690 A1 Jan. 10, 2019

(30) Foreign Application Priority Data

Aug. 7, 2015 (IT) ..... 102015000043304

(51) Int. Cl.
*E04B 1/26* (2006.01)

(52) U.S. Cl.
CPC .... *E04B 1/2604* (2013.01); *E04B 2001/2628* (2013.01); *E04B 2001/2636* (2013.01)

(58) Field of Classification Search
CPC .. E04B 1/20; E04B 1/2604; E04B 2001/2628; E04B 2001/2636; E04B 2001/2409; E04B 2001/2644; Y10T 403/65; Y10T 403/46; Y10T 403/4605; Y10T 403/4608; Y10T 403/4621

See application file for complete search history.

(56) References Cited

U.S. PATENT DOCUMENTS 1,972,108 A * 9/1934 Richardson ..... F16B 12/58 5/296
4,299,509 A 11/1981 Meickl
5,295,754 A * 3/1994 Kato ..... E04B 1/26 403/174
5,688,069 A * 11/1997 Hoshino ..... E04B 1/215 403/333
5,827,006 A 10/1998 Hoshino
(Continued)

FOREIGN PATENT DOCUMENTS

| | | |
|---|---|---|
| CA | 2291330 | 5/2001 |
| EP | 0866186 | 9/1998 |
| WO | WO 2014/141073 | 9/2014 |

*Primary Examiner* — Jonathan P Masinick
(74) *Attorney, Agent, or Firm* — Leason Ellis LLP

(57) ABSTRACT

A connection device in particular for building construction, has an upright, a beam and a pair of first plates, which are flat and vertical, are fixed with respect to the upright, project horizontally from the upright and are parallel to each other; the device also has a pair of second plates, which are fastened to one end of the beam, are placed on the outer side faces of such end are flat and vertical, coplanar respectively to the first plates and rest on the first plates solely at an inclined plane, which causes a forcing of the end of the beam horizontally against the upright in response to a forcing of the second plates downwards along such inclined plane.

10 Claims, 3 Drawing Sheets

(56) References Cited

U.S. PATENT DOCUMENTS

| | | | | |
|---|---|---|---|---|
| 6,113,205 | A * | 9/2000 | Kuo | F16B 12/125<br>108/143 |
| 2006/0165482 | A1 * | 7/2006 | Olberding | E04B 1/24<br>403/381 |

* cited by examiner

CONNECTION DEVICE FOR FASTENING TWO ELEMENTS, IN PARTICULAR FOR BUILDING CONSTRUCTION

CROSS-REFERENCE TO RELATED PATENT APPLICATIONS

This application is a U.S. National Phase Application under 35 U.S.C. § 371 of International Patent Application No. PCT/IB2016/054762, filed Aug. 6, 2016, which claims the priority of Italian Application No. 102015000043304, filed Aug. 7, 2015, which is incorporated by reference as if expressly set forth in its entirety herein.

TECHNICAL FIELD

The present invention relates to a connection device for fastening two elements, in particular for building construction.

BACKGROUND ART

The Italian patent application TO2013A000192 and international patent application published as number WO2014141073A1, on behalf of the same applicant, describe a connection device for fastening a beam to a weight-bearing element, such as an upright, in the construction industry. The beam end has two vertical slits, while the upright is equipped with two vertical support plates which project horizontally so as to engage a lower area of the slits. The slits house respective upper plates, which are fastened to the beam and rest on the top edge of the two support plates.

A similar solution is also shown in the document U.S. Pat. No. 4,299,509, where the beam end has a single slit.

In such solutions, it is considerably difficult to fasten the upper plates at a precise position inside the slits provided in the beam.

In addition, the machining to make the slits at the ends of the beam must be performed accurately. In particular, in solutions where the beam end has two slits, their perfect parallelism is considerably difficult to achieve.

Furthermore, the wood of the beam, with the passage of time, does not maintain its shape and dimensions, so that during installation there may be slight differences from the original machining results.

In addition, expedients are required to give the beam greater freedom to be forced downwards and to enable the loads on the beam to be optimally discharged onto the upright.

The document CA2291330A1 corresponds to the preamble of claim 1 and shows a coupling system with a plurality of plates fastened to one side of a beam, to couple said beam to a vertical support plate, placed between two horizontal flanges of a beam with a H-shaped cross-section.

DISCLOSURE OF INVENTION

The purpose of the present invention is to provide a connection device for fastening two elements, in particular for building construction, which makes it possible to overcome in a simple and economical manner the drawbacks described above and, preferably, ensure a firm and secure blocking.

According to the present invention a connection device for fastening two elements is provided, in particular for building construction, as defined in claim 1.

The present invention also relates to a method for fastening two elements, according to claim 7.

BRIEF DESCRIPTION OF THE DRAWINGS

The invention will now be described with reference to the accompanying drawings, which illustrate a non-limiting embodiment thereof, in which.

BEST MODE FOR CARRYING OUT THE INVENTION

Figure 1:
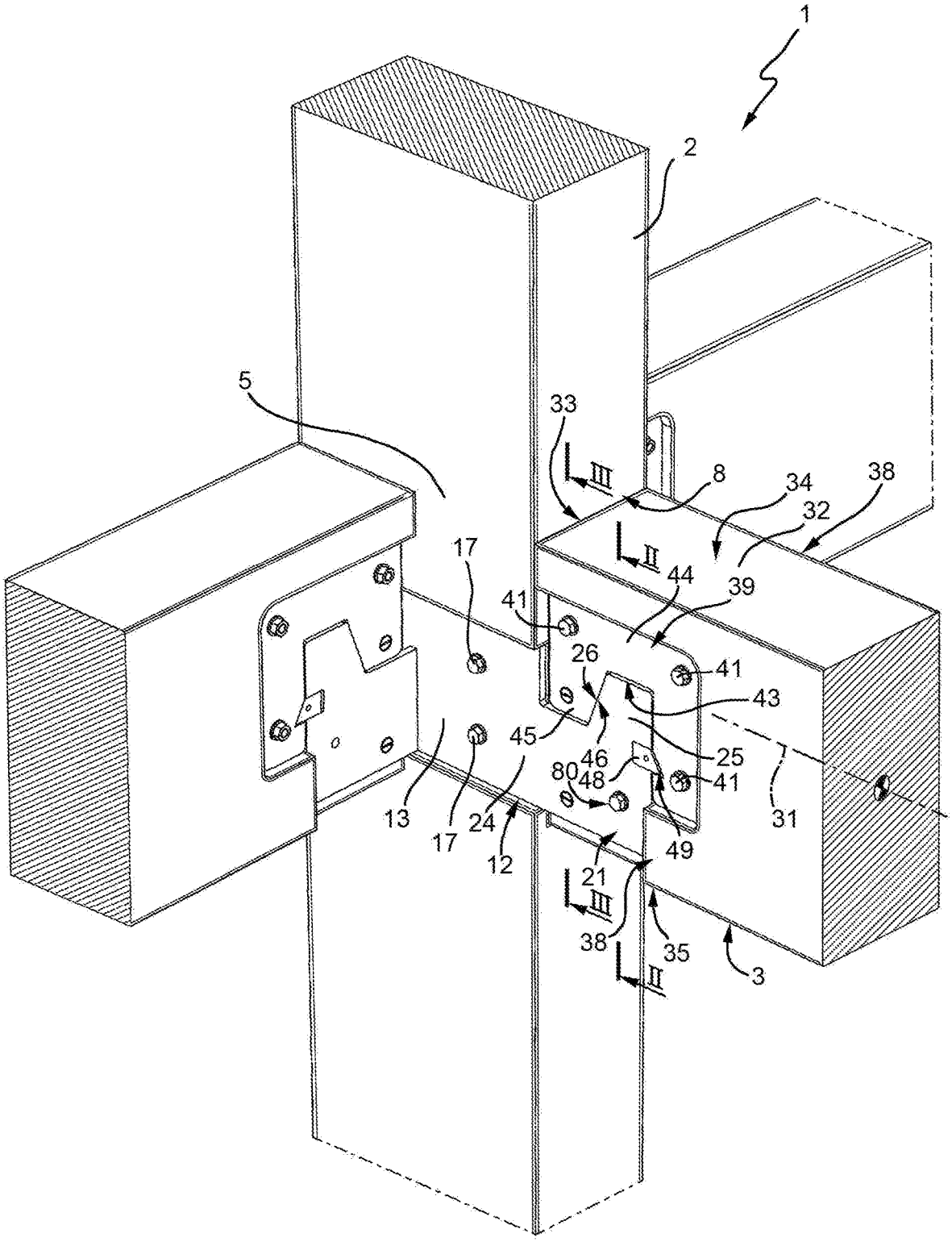
FIG. 1 is a perspective view of a preferred embodiment of the connection device for fastening two elements, in particular for building construction, according to the present invention.

In FIG. 1, reference numeral 1 denotes a connection device for fastening two elements. The connection device 1 is advantageously, but not exclusively, used in building construction, for example for the production of wooden frames for prefabricated houses, for the construction of fences or railings, etc. Alternatively, the device 1 could also be used for the assembly of furniture (bookcases, cabinets, etc.) or for the assembly of construction games.

The connection device 1 comprises two elements indicated by reference numerals 2 and 3 and made, conveniently, of wood.

Preferably, the element 3 is a beam. In particular, the element 2 is defined by an upright which extends along a vertical axis: the following description will refer to this embodiment without, however, losing its general application: in fact, according to variations not shown, the element 2 may be defined by another horizontal-axis beam.

The upright 2 comprises a connection portion 5 having an outer face 8 and bearing two supports 12, which are fastened to the portion 5, are arranged on opposite sides of the face 8 and are made of a more rigid and/or more resistant material than the material of the upright 2, for example of steel.

The supports 12 comprise respective attachment portions 13 fastened to the portion 5, for example by screws or bolts. Each of the portions 13 may be placed on an outer face of the portion 5 or in a slit made in said portion 5. Preferably, the portion 5 is clamped between the two portions 13 by means of at least two horizontal tie rods 17 which extend in respective horizontal holes of the portion 5.

The two supports 12 also comprise respective plates 21, which are vertical, flat and parallel to each other. At least a part of the plates 21 projects horizontally from the face 8.

Each of the plates 21 comprises an arm 24 and an end portion 25, which is connected to the portion 13 via the arm 24 and defines an upward projection with respect to the arm 24. The portion 25 has an edge which faces upwards and towards the face 8 and defines an inclined plane 26 with a downward gradient, going from the outside towards the face 8.

Again with reference to FIG. 1, the beam 3 is elongated along an axis 31 which is transverse to the face 8 and, in particular, is horizontal. In variants not shown, for example to form roof trusses, the axis 31 is tilted from the horizontal. The beam 3 ends with an attachment portion 32 defined by: a front face 33, which is transverse to the axis 31 and is parallel to the face 8 so as to rest against the latter; an upper face 34; a lower face 35; and two side faces 38 opposite each other.

Advantageously, the side faces 38 are flat, vertical and parallel to each other. In particular, the faces 33 and 8 are vertical.

Figure 2:
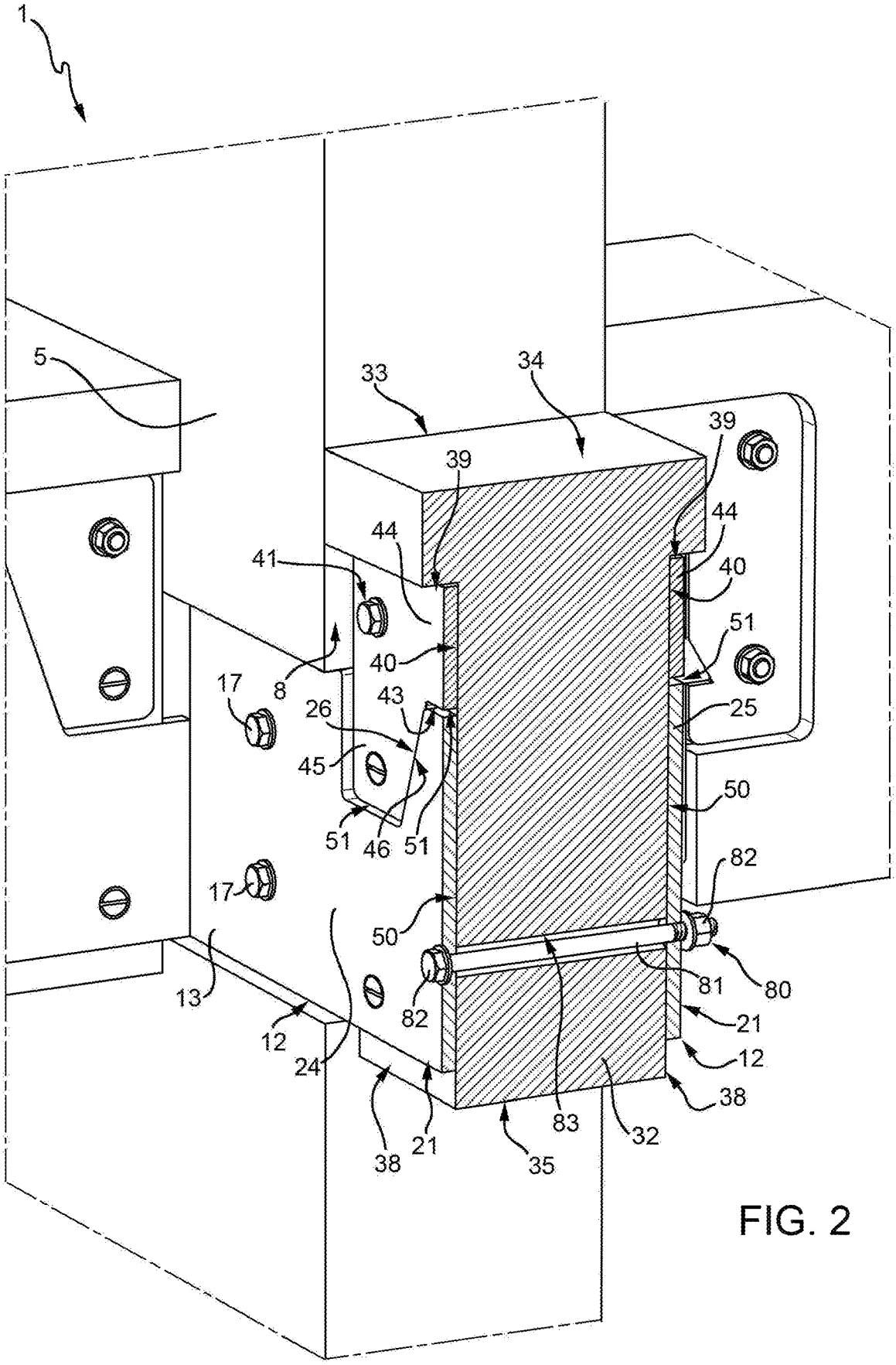
FIGS. 2 and 3 are perspective views, magnified, with cross-sections according to vertical cross-section planes indicated by the lines II-II and III-III respectively in FIG. 1.

With reference to FIG. 2, the device 1 further comprises two plates 39, which are flat and vertical, respectively coplanar to the plates 21, fastened to the portion 32 and which rest, directly or via spacers, on an area 40 of the side faces 38. Preferably, the plates 39 are connected together by at least two tie rods 41 which extend in respective horizontal holes 42 (FIG. 3) of the portion 32, substantially without radial clearance, and clamp the portion 32 between the plates 39, without possible threads engaging in the wood of the portion 32. The plates 39 and possible tie rods 41 are made of a material which is more rigid and/or more resistant than the material of the beam 2, for example of steel.

Advantageously, the plates 39 have an upside down U-shape so as to define, at the bottom, respective recesses 43 engaged by the portions 25 of the plates 21. The plates 39 comprise respective portions 44, defining the upper end of the recesses 43, and respective portions 45, which project from the portions 44 toward the arms 24 and have respective lower edges which rest on the inclined planes 26, respectively. In particular, said lower edges define an inclined plane 46 which corresponds with the inclined planes 26.

With reference to FIG. 1, if necessary, the device 1 may include two latches or teeth 48 which are guided by the portions 25 in planes coplanar to the plates 39 and 21, so as to slide between a retracted position, to allow the portions 25 to enter the recesses 43 and let the inclined planes 46 slide freely on inclined planes 26 during installation; and a locking position, in which the teeth 48 project horizontally from the portions 25 to engage respective stop seats 49 made in the plates 39 and thus prevent raising of the plates 39 and, thus, of the beam 3. In a dual manner, the stop seats 49 may be made in the portions 25 and the teeth 48 be guided by the plates 39.

With reference to FIG. 2, during installation, as mentioned above, the portion 32 is inserted and lowered between the plates 21, which thus slide in contact with an area 50 of the side faces 38 under the areas 40. During this coupling, the inclined planes 46 rest and slide on the inclined planes 26 until the face 33 axially rests against the face 8. According to one aspect of the present invention, when the beam 3 reaches this position, the support between the plates 21 and 39 takes place solely at the inclined planes 26 and 46. In other words, throughout the remaining part of the edges of the plates 39 and 21, there is an empty space or "gap" 51 (in particular between the portions 44 and 26 and between the arms 24 and the portions 45). The gap 51 gives the beam 3 the freedom to settle in its vertical position and makes it possible to force at will the face 33 against the face 8. In particular, the vertical load (sum of any load exerted on the surface 34 and the weight of the beam 3) is discharged from the wood of the portion 32 to the plates 39 and, therefore, from the inclined planes 46 of the plates 39 to the inclined planes 26 of the plates 21: thanks to the inclination of the planes 46 and 26, the vertical load is broken down into a vertical component and a horizontal component, the response of which is to clamp the portion 32 against the face 8 of the upright 2.

This horizontal component, which thus discharges on the upright 2, reduces the vertical stresses in the coupling zones between the wood of the beam 3 and the plates 39. The magnitude of the horizontal component depends on the slope of the inclined planes 26 and 46 from the vertical. Advantageously, said slope is less than 25°.

Figure 3:
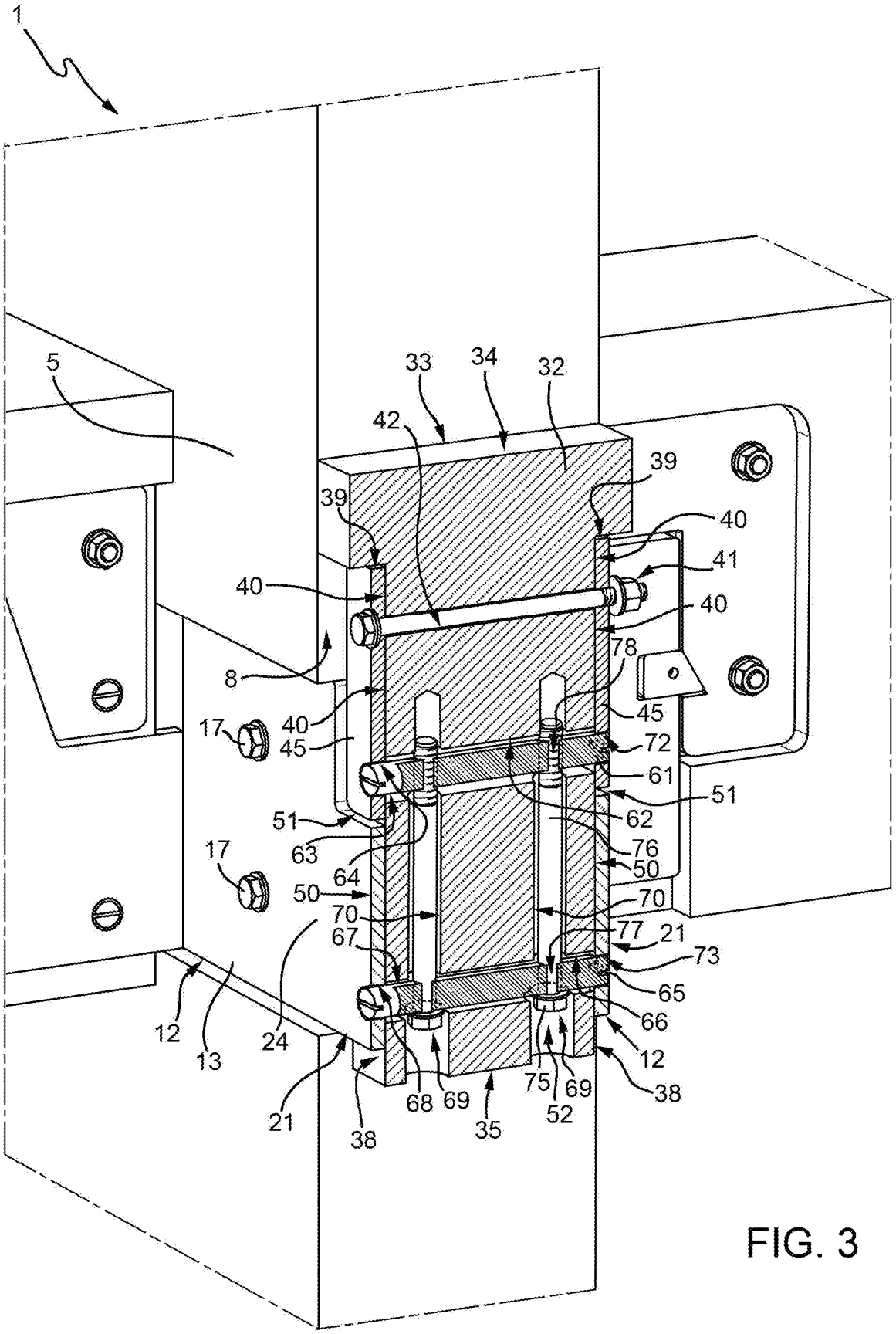

With reference to FIG. 3, if necessary, the device 1 may comprise a mechanical system 52 to further force the plates 39 downwards and then keep the beam 3 locked in the vertical in the position reached. In particular, the system 52 comprises:

- an upper bar 61, which extends with clearance in a horizontal hole 62 of the portion 32 and has a lower surface 63 resting vertically on a shoulder edge 64 of the plates 39;
- a lower bar 65, which extends with clearance in a horizontal hole 66 made in the portion 32 and has an upper surface 67 resting vertically on a shoulder edge 68 of the plates 21; and
- at least one tie rod 69, which is arranged in a hole 70 of the portion 32 (so that it remains hidden), is coupled to both the bars 61 and 65, is rotatable about its axis and is configured so as to pull the bars 61 and 65 towards each other and thus bring the shoulder edges 64 and 68 together in response to a rotation of said tie rod 69 about its own axis.

The material of the system components 52 is stiffer and/or more resistant than the material of the upright 2 and of the beam 3 and is preferably steel.

Advantageously, the bars 61 and 65 are vertically aligned with each other and the tie rod 69 is therefore vertical.

In the particular example illustrated, the shoulder edge 64 is defined by holes 72 which are made in the plates 39, are aligned with the hole 62 and are engaged by the ends of the bar 61; and the shoulder edge 68 is defined by holes 73 which are made in the plates 21, aligned with the hole 66 and engaged by the ends of the bar 65. Alternatively, the shoulder edges 64, 65 are defined by upper and lower end edges of the plates 39, 21.

In particular, the tie rod 69 is defined by a screw, which comprises: a head 75 resting (directly or via spacers) on the side surface of one of the bars 65, 61; and a stem 76, which passes through a hole 77 of said bar with clearance and is screwed into a threaded hole 78 of the other of the bars 65, 61.

According to a variation not shown, the tie rods 69 are placed in view, laterally externally to the plates 21, 39. In this case, the tie rods 69 may differ from those shown and be attached to the plates 21, 39 without providing the bars 61, 65 and the holes 62, 66.

With reference to FIG. 2, according to one aspect of the present invention, during installation, after having positioned the portion 32 between the plates 21 and possibly having forced it down, the plates 21 are coupled together via a tie rod 80 configured so as to prevent the plates 21 from moving apart and thus to keep them coplanar to the plates 21, despite any deformation of the wood occurring over the passage of time. In other words, the tie rod 80 keeps the inner face of the plates 21 resting (either directly or through spacers) against the areas 50 of the side faces 38.

The tie rod 80 is the same as the tie rods 41, to prevent any threads engaging in the wood of the portion 32. In particular, the tie rod 80 comprises a pin 81 threaded at the ends and two nuts 82 screwed on said ends. The pin 81 extends with radial clearance through a horizontal hole 83 of the portion 32. This way, the tie rod 80 also performs a blocking function to prevent a lifting of the beam 3 in relation to the plates 21, alternatively or combined with the same function performed by the teeth 48 and/or system 52. At the same time, the nuts 82 abut against the outer faces of the plates 21 (either directly or through spacers), to obtain the function of preventing the moving apart described above.

Preferably, after installation, the plates 39 are hidden by mounting respective caps or covers (not shown), for example made of plastic, and fastening said caps or covers to the portion 32 using glue, by snap-fitting or with screws.

It is clear from the above that, thanks to the inclined plane defined by the edges of the portions 25 and 45 and thanks to the gap 51, the beam 3 is free to descend said inclined plane with ample freedom in order to force the face 33 against the side face 8 and thus obtain a connection device which can support heavy loads.

At the same time, the plates 39 being arranged outside the portion 35, it is relatively easy to obtain the parallelism between the plates 39 and the exact distance between the plates 39 required by the design. In fact, the side faces 38 must be machined to achieve such results, without the need to make holes or splits inside the wood of the portion 35. In addition, the plates 39 are also relatively simple to fasten to the portion 35 in precise positions and are relatively simple to couple, during installation, to the plates 21, since they are visible.

The tie rod 80 makes it possible to keep the plates 39 coplanar to the plates 21 at all times. In particular, the distances between the plates 21 and between the plates 39 are defined solely by the distance between the side faces 38.

Also, as mentioned above, the tie rod 80, as also the tie rods 41 and 17, does not grip by means of threads in the wood, with consequent benefits to the security and stability of the coupling of the entire device 1.

From the above it appears evident that modifications and variations may be made to the device 1 described with reference to the appended drawings while remaining within the scope of protection of the present invention, as defined in the appended claims.

In particular, the plates 39 may have shapes other than that shown, for example they could be defined solely by the portions 45.

Additionally, only the pair of inclined planes 26 or only the pair of inclined planes 46 could be provided, while the other pair could be replaced by edges shaped differently (but still so as to slide and force the plates 39 and the beam 3 towards the portion 5 during the lowering of said plates 39 during installation).

Finally, as mentioned above, the device 1 could be used in a sector other than that of building construction; in such case, plastic materials could also be used and/or the element 3 could be defined by a shelf, rather than by a beam.

The invention claimed is:

1. Connection device (1) for fastening two elements, in particular for building construction, the device comprising:

a first element (2);

a second element (3) ending with an attachment portion (32) defined externally by a front face (33) and by two side faces (38) opposite to each other and horizontally spaced apart from each other;

a pair of first plates (21), which are fixed with respect to said first element (2) and are flat, vertical and parallel to each other;

a pair of second plates (39), which are fastened to said attachment portion (32), are flat and vertical and are coplanar respectively to said first plates (21);

an inclined plane defining a coupling between said first and second plates (21, 39) and configured so as bring said front face (33) horizontally in contact against said first element (2) in response to a sliding movement of said second plates (39) downwards along said inclined plane;

characterised in that:

said first plates (21) horizontally project from said first element (2);

said front face (33) is arranged horizontally in contact against said first element (2) at the end of said sliding movement;

said first and second plates (21, 39) are in direct contact with each other only at said inclined plane, so as to allow a forcing of said front face (33) horizontally against said first element (2) in response to a possible further sliding movement of said second plate (39) downwards along said inclined plane;

one of said first plates and one of said second plates (21, 39) being placed on one of said side faces (38); the other of said first plates and the other of said second plates (21, 39) being placed on the other side of said side faces (38).

2. Device according to claim 1, characterised in that said first and second plates (21, 39) rest, directly or by means of spacers, on respective areas (40, 50) of said side faces (38).

3. Device according to claim 2, characterised by comprising at least one retaining member (80) configured so as to prevent said first plates (21) from spreading apart with respect to said side faces (38).

4. Device according to claim 3, characterised in that said retaining member (80) passes, with radial clearance, through a horizontal hole (83) made in said attachment portion (32) and has the ends coupled to said first plates (21).

5. Device according to claim 1, characterised by comprising at least two tie rods (41) that clamp said attachment portion (32) tightly between said second plates (39).

6. Device according to claim 1, characterised by comprising a mechanical system (52) configured so as to vertically pull said second plates (39) towards said first plates (21) and then maintain said second plates (39) vertically locked in the reached position.

7. Method for fastening two elements, in particular for building construction, by means of a connection device according to claim 1; the method comprising the steps of:

inserting said attachment portion (32) between said first plates (21) and making said second plates (39) slide downwards along said inclined plane until said front face (33) rests against said first element (2);

making said second plates (39) further slide downwards along said inclined plane so as to force said front face (33) horizontally against said first element (2).

8. Method according to claim 7, characterised by also comprising the steps of:

inserting a retaining member (80) through a horizontal hole (83) of said attachment portion (32), with radial clearance, after the forcing step;

coupling the ends of said retaining member (80) respectively to said second plates (39) so as to prevent said first plates (21) from spreading apart with respect to said side faces (38).

9. Method according to claim 7, characterised in that the forcing step is performed by means of a load applied to said second element (3).

10. Method according to claim 7, characterised in that the forcing step is performed by vertically pulling said second plates (39) towards said first plates (21) by means of a mechanical system.

* * * * *